US006033197A

United States Patent [19]

Brown et al.

[11] Patent Number: 6,033,197

[45] Date of Patent: Mar. 7, 2000

[54] GEAR PUMP HAVING A BLEED SLOT CONFIGURATION

[75] Inventors: Steven J. Brown, Marseilles; Vijay P. Shah, Peoria Hts., both of Ill.

[73] Assignee: Caterpillar Inc., Peoria, Ill.

[21] Appl. No.: 09/037,257

[22] Filed: Mar. 9, 1998

Related U.S. Application Data

[62] Division of application No. 08/544,909, Oct. 18, 1995.

[51] Int. Cl.[7] ..... F04C 2/18

[52] U.S. Cl. ..... 418/180; 418/206.4

[58] Field of Search ..... 418/78, 180, 206.1, 418/206.4

[56] References Cited

U.S. PATENT DOCUMENTS

| | | | |
|---|---|---|---|
| 2,870,720 | 1/1959 | Lorenz | 418/78 |
| 3,474,736 | 10/1969 | Lauck | 418/180 |
| 4,355,964 | 10/1982 | Rodibaugh et al. | 418/78 |

FOREIGN PATENT DOCUMENTS

| | | | |
|---|---|---|---|
| 59-153993 | 9/1984 | Japan | 418/180 |

*Primary Examiner*—John J. Vrablik
*Attorney, Agent, or Firm*—J. W. Burrows

[57] ABSTRACT

A method and apparatus is provided for producing a gear pump/motor in a low cost and efficient manner that can effectively operate in air entrained oil without emitting undesirable noises. This is accomplished by providing bleed slots in a housing adjacent an outlet passage at a location that allows first and second intersecting cavities to be machined with the same boring tool. The bleed slots have a length defined by the distance between two adjacent teeth of first and second intermeshing gears and a cross-sectional area at the mid-point of the arcuate length that is defined by multiplying the flow of the pump at a given RPM time a derived constant. The machining of the body of the gear pump/motor is accomplished in a low cost and efficient manner to produce a gear pump/motor that operates in air entrained oil without emitting undesirable noises.

8 Claims, 5 Drawing Sheets

GEAR PUMP HAVING A BLEED SLOT CONFIGURATION

This is a divisional application of application Ser. No. 08/544,909, filed Oct. 18, 1995.

TECHNICAL FIELD

This invention relates generally to a method and apparatus for producing a gear pump and more particularly, to a method for producing a gear pump having structure to substantially reduce the noise and pressure ripple generated by the pump during operation.

BACKGROUND ART

As is well known in the art, gear pumps can operate effectively in systems having entrained air in the hydraulic oil. However, the entrained air in the oil creates problems, such as, cavitation. Cavitation can cause erosion of pump components, system noise, and discharge pressure ripples. The noise is basically caused by imploding or collapsing the entrained air the oil is suddenly subjected to the high pressure at the discharge side of the pump. Many attempts have made to overcome this problem. In some instances, air separators have been installed to separate the air from the oil prior to the oil entering the pump. In other instances, special porting has been added to the pump housing in order to force the entrained oil through bleed orifices back to the reservoir prior to the oil entering the discharge passage. In yet other instances, special bleed slots have been added to the pump housing to pre-pressurize the air prior to the oil and air mixture entering the discharge passage. In these instances, the slots have either been too large or too many which results in too much leakage of high pressure oil and/or too much side loading on the bearings of the pump. Likewise, in some instances the operation of machining the bleed slots is too costly.

The present invention is directed to overcoming one or more of the problems as set forth above.

DISCLOSURE OF THE INVENTION

In one aspect of the present invention, a method is provided for producing a gear pump having structure that reduces noise levels therein caused by air in the oil. The method includes the steps of forming a housing having a first surface, first and second intersecting cavities generally perpendicular to the first surface, first and second shaft bores at the bottom of the respective first and second intersecting cavities, a second surface at the bottom of the first and second intersecting cavities, an inlet passage communicating with at least a portion of the first and second surfaces and one side of the intersecting cavities, an outlet passage communicating with at least a portion of the first and second surfaces and the other side of the intersecting cavities; machining the first and second intersecting cavities with a boring tool; machining a first bleed slot with the boring tool at a location generally adjacent the intersection of the first cavity, the first surface, and the outlet passage; machining a second bleed slot with the boring tool at a location generally adjacent the intersection of the second cavity, the first surface, and the outlet passage; inserting intermeshing first and second gears having gear shafts extending therefrom in the respective first and second intersecting cavities and the respective shaft bores; placing a cover plate having a third surface and first and second shaft bores therein over the respective gear shafts of the respective intermeshing first and second gears; and securing the housing and cover plate with fasteners.

In another aspect of the present invention another method is provided for producing a gear pump having structure that reduces noise levels therein caused by air in the oil. The method includes the steps of forming a body having first and second surfaces, first and second intersecting cavities defined therein perpendicular with the first and second surfaces, an inlet passage communicating with one side of the first and second intersecting cavities, an outlet passage communicating with the other side of the first and second intersecting cavities, a first finished arcuate bleed slot defined adjacent the intersection of the first surface, the first cavity, and the outlet passage, and a second finished arcuate bleed slot defined adjacent the intersection of the first surface, the second cavity, and the outlet passage; machining the first and second intersecting cavities to a predetermined size with a boring tool; inserting intermeshing first and second gears having gear shafts extending therefrom in the respective first and second intersecting cavities; placing first and second cover plates each having first and second shaft bores defined therein on opposite sides of the body over the respective gear shafts and into contact with the respective first and second surfaces of the body; and securing the first and second covers to the body with fasteners.

In yet another embodiment of the present invention, a bleed slot configuration is provided for use in a gear pump to reduce the noise level attributed to air in the oil. The gear pump includes a housing with a first surface, first and second intermeshing gears disposed in respective first and second intersecting cavities, a cover plate secured to the housing in contact with the first surface, an inlet passage communicating with one side of the intermeshing gears and an outlet passage communicating with the opposite side of the intermeshing gears. The bleed slot configuration comprises forming a first bleed slot in the housing generally adjacent the intersection of the surface, the first cavity, and the outlet passage and a second bleed slot in the housing generally adjacent the intersection of the surface, the second cavity, and the outlet passage, the first and second bleed slots each having an arcuate length generally equal to the length between corresponding points on adjacent teeth of the associated gear.

BEST MODE FOR CARRYING OUT THE INVENTION

Figure 1:
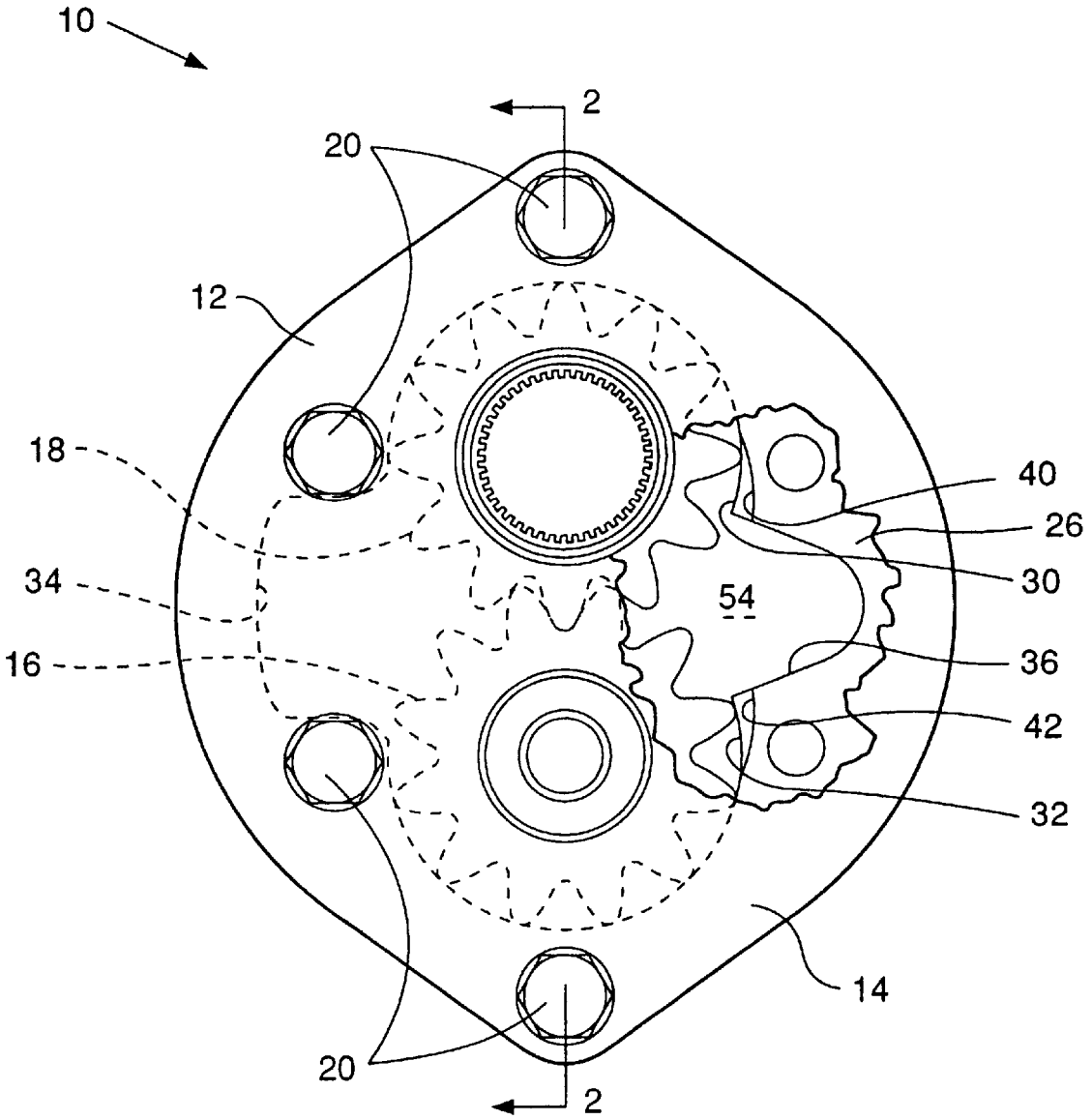
FIG. 1 is a diagrammatic representation of a gear pump incorporating an embodiment of the present invention and produced by the subject method.
Figure 2:
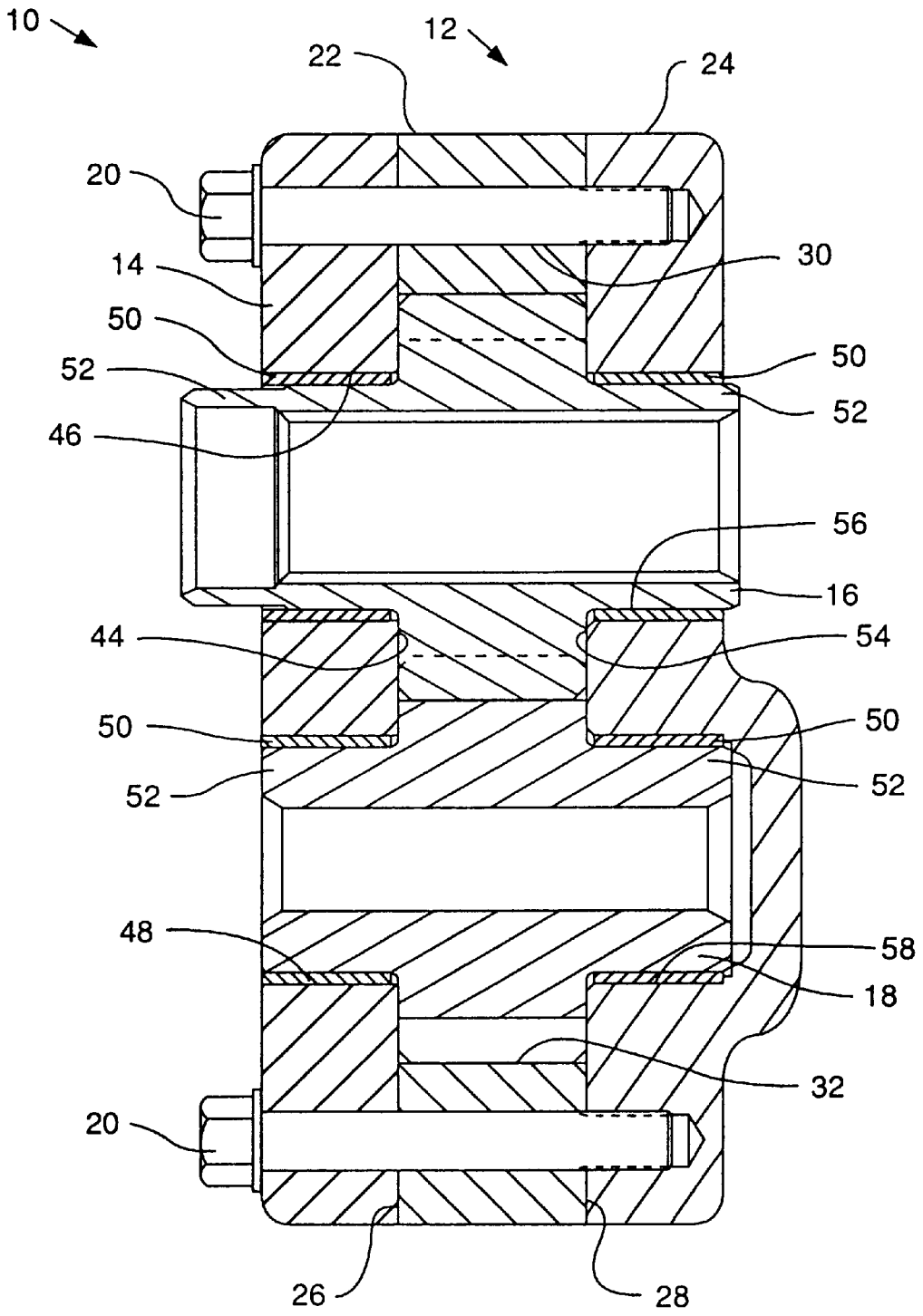
FIG. 2 is a sectional view taken through 2—2 of FIG. 1.

Referring to FIGS. 1 & 2, a gear pump 10 is diagrammatically illustrated and includes a housing 12, a first cover plate 14, first and second intermeshing gears 16,18, and a plurality of fasteners 20. The housing 12 of the subject embodiment is composed of a body 22 and a second cover plate 24. Even though the following description discusses the body and the second cover plate 24, it is recognized that the body 22 and the second cover plate 24 could be a one piece housing 12 without departing from the essence of the invention. All remarks relative to the second cover plate 24 and the body 22 also relate to the two elements being joined to form the one piece housing 12. Likewise, the subject invention could be applicable to a fluid gear motor.

The body 22 has a first and second surfaces 26,28, first and second general circular intersecting cavities 30,32 perpendicular to the first surface 26, an inlet passage 34 communicating with at least a portion of the first and second intersecting cavities 30,32, and an outlet passage 36 communicating with at least another portion of the first and second intersecting cavities 30,32. A first bleed slot 40 is defined on the body 22 at the intersection of the first surface 26, the first intersecting cavity 30 and the outlet passage 36. A second bleed slot 42 is defined on the body 22 at the intersection of the first surface 26, the second intersecting cavity 32 and the outlet passage 36. Each of the bleed slots 40,42 are arcuate in shape having the greatest cross-sectional area at the intersection of the bleed slot with the outlet passage 36 and decreases in size along it arcuate length to the point of intersection with the respective first and second intersecting cavities 30,32. The radius of each of the first and second bleed slots 40,42 is substantially equal to the radius the respective first and second intersecting cavities 30,32.

The cross-sectional area of each of the bleed slots 40,42 at their respective mid-point along the arcuate length is determined by multiplying the flow of the pump 10 at a given RPM times a derived constant. In the subject embodiment, the speed of the pump is approximately 1800 RPM and the derived constant is approximately 0.12. However, it is recognized that the derived constant could be varied without departing from the essence of the invention. The derived constant is based in general on the quality of the oil, that is the percent of air per unit volume in the oil. It is recognized that the percent of air in the oil is, at least in part, based on the RPM of the pump. Consequently, when the pump is operating at a lower RPM, the percent of air in the oil is lower and a smaller derived constant could be used. However, if the pump is being operated at a higher RPM, then a larger derived constant could be used. In the subject invention, the derived constant could be within a range of approximately 0.08 to approximately 0.16 and still obtain satisfactory results. As noted above, the operating range of the pump is approximately 1800 RPM and the derived constant of 0.12 provides very good results. The percent of air per unit volume in the oil is in the range of 5 to 20 percent.

The arcuate length of each of the bleed slots 40,42 is generally equal to the distance between two corresponding points of adjacent teeth of the respective first and second intermeshing gears 16,18. It is recognized that the arcuate length could vary somewhat. However, it has been determined that if the length is to short the effectiveness of the noise reduction is lowered. Likewise, if the length is to long, detrimental side loads are subjected to the shaft bearings which results in shortened bearing life.

The first cover plate 14 has a surface 44 and first and second shaft bores 46,48 with a bearing 50 disposed in each of the shaft bores 46,48. When assembled, the surface 44 of the first cover plate 14 mates with the first surface 26 of the body 22 and the first and second shaft bores 46,48 are slidably disposed over respective gear shafts 52 extending from both sides of the respective first and second intermeshing gears 16,18.

The second cover plate 24 has a surface 54 and first and second shaft bores 56,58 with respective bearings 50 disposed therein. When assembled, the surface 54 of the second cover plate 24 mates with the second surface 28 of the body. With a one piece housing 12, the bottom of the respective first and second intersecting cavity serves as the surface 54 of the second cover plate 24. Likewise the first and second shaft bores 56,58 are defined in the one piece housing at the bottom of the first and second intersecting cavities 30,32.

Figure 3:
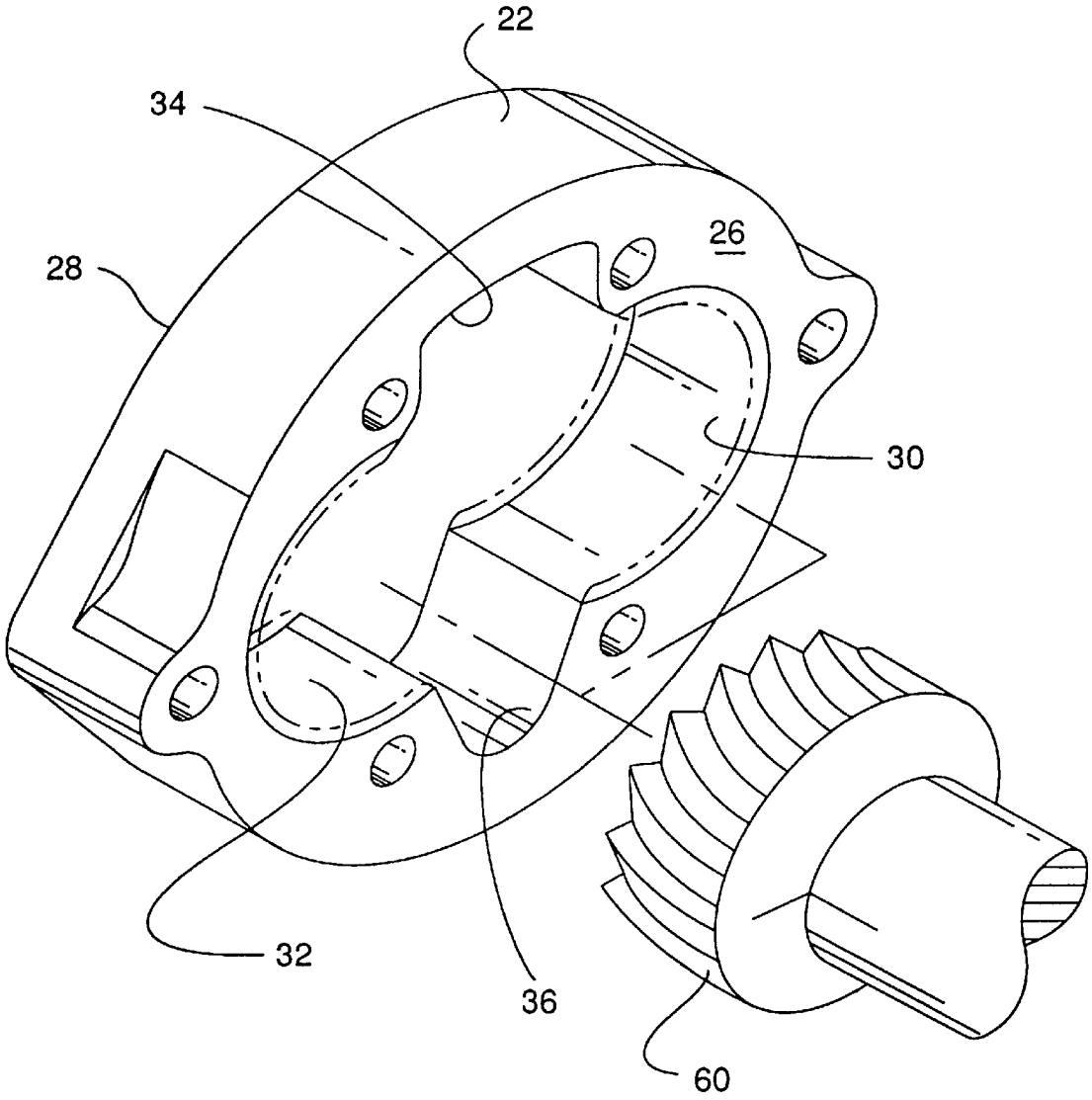
FIG. 3 is a diagrammatic, isometric view illustrating one step of the method of the subject invention.
Figure 4:
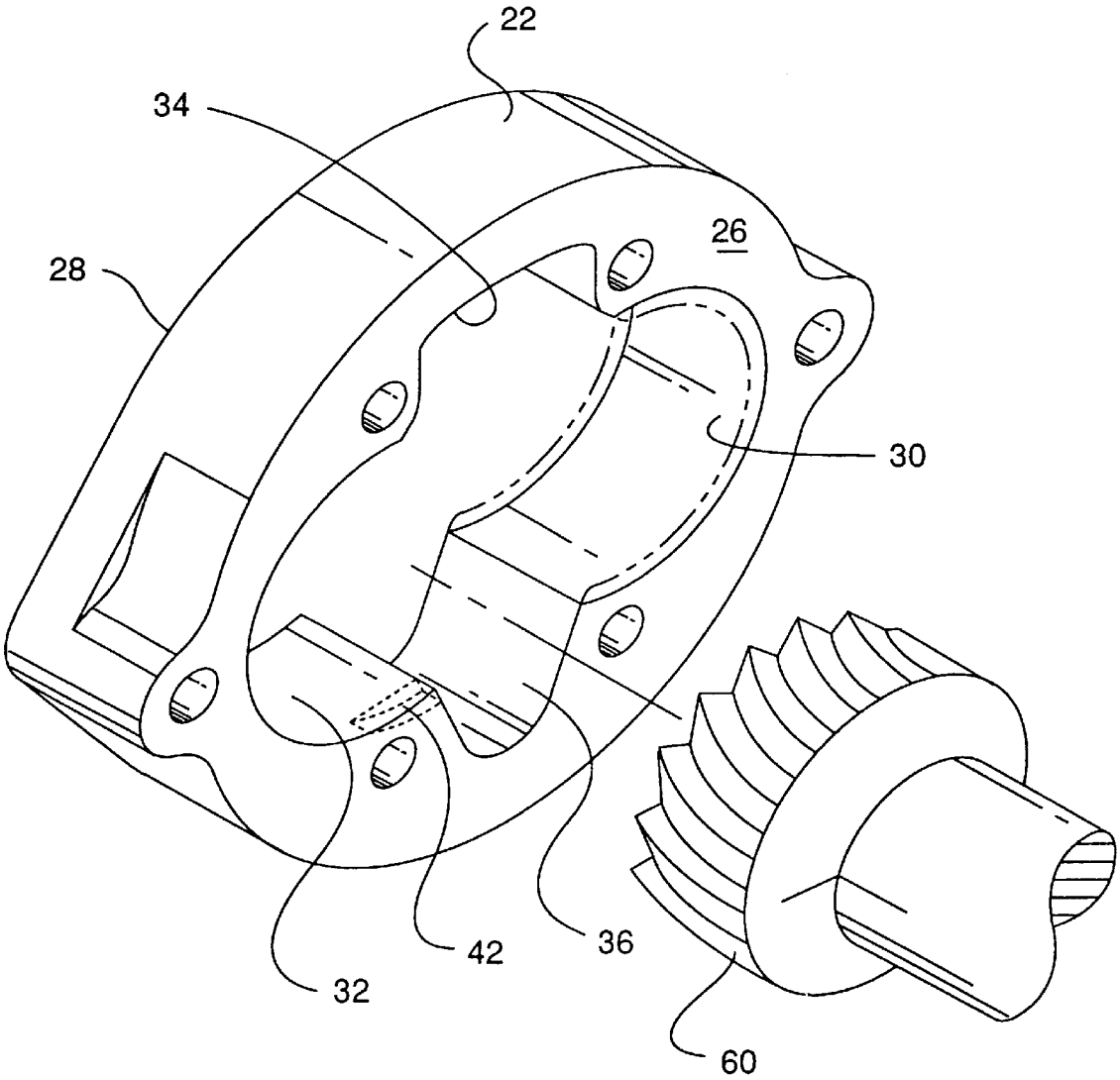
FIG. 4 is a diagrammatic representation of another step of the subject method.
Figure 5:
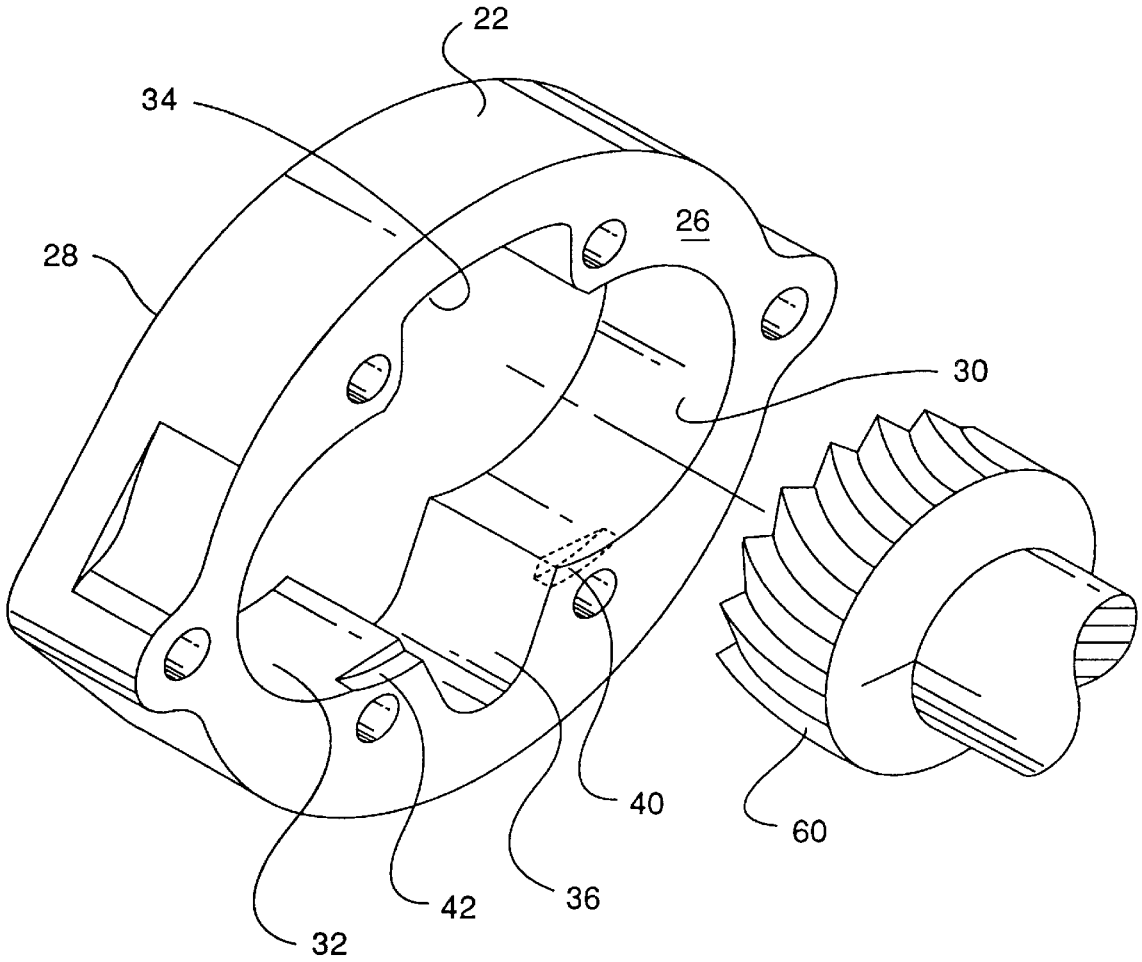
FIG. 5 is a diagrammatic representation of another step of the subject method.

Referring to FIGS. 3–5, a method of producing a portion of the gear pump 10 is illustrated. In FIG. 3, the body 22 is illustrated with the first and second intersecting cavities in their pre-machined condition. Note the extra material illustrated in phantom. As illustrated, a boring tool 60 is used to bore the respective first and second intersecting cavities 30,32. If a one piece housing 12 is used, the boring tool 60 would also machine the surface 54 at the bottom of the respective cavities 30,32.

Following machining of the respective first and second intersecting cavities 30,32, the boring tool is positioned at a predetermined location relative to the centerlines of the first and second intersecting cavities 30,32 and machines the respective first and second bleed slots 40,42 to a predetermined depth as illustrated. By using the same boring tool 60 to machine the first and second intersecting cavities 30,32 and the first and second bleed slots 40,42, large amounts of time is saved as compared to changing the tool or having to use a special tool to locate bleed slots in the body 22 at other locations. It is recognized, as illustrated in FIGS. 4 & 5 that the first bleed slot 40 could be machined after the first intersecting cavity 30 is machined as opposed to machining both cavities first without departing from the essence of the invention.

In an alternate embodiment of the present invention, the body 22 is made by a powder metallurgy process, a die casting process, or any process that forms a substantially finished product. In the another embodiment the first and second intersecting cavities 30,32 and the first and second bleed slots 40,42 are finished formed. In some applications it is recognized that a light finish machine step may be needed in the first and second intersecting cavities 30,32 to provide the necessary tolerances in order to 30 reduce leakage between the surfaces thereof and the corresponding first and second intermeshing gears 16,18.

INDUSTRIAL APPLICABILITY

During the operation of the gear pump 10, fluid, such as oil, is drawn into the inlet passage 34 and as the first and second intermeshing gears 14,16 rotate, the oil is transported from the inlet passage 34 to the outlet passage 36 between the respective teeth in a well known manner. Likewise, as is well known, due to the action of the teeth meshing in the outlet passage 36, the oil is forced to exit through the outlet passage 36. As is well known, the pressure of the fluid in the outlet passage 36 is determined by the resistance to fluid flow encountered downstream thereof. In many systems, large amounts of air become mixed with the oil in the reservoir and associated lines and forms bubbles or pockets. These entrained air bubbles/pockets are then carried into and through the gear pump 10. Without the subject invention, as the entrained air bubbles/pockets enters the outlet passage 36, the pressure in the outlet passage 36 causes them to suddenly collapse or implode. This sudden collapse of the entrained air bubbles/pockets causes an audible noise that is many times loud and undesirable. This sudden collapse of entrained bubbles/pockets also produces pressure ripples or vibration to the gear pump 10 that is further transmitted to associated lines and other structures resulting in additional noise and/or premature failure of the associated components.

Flow ripples affect the effective flow rate from the pump since the air bubbles occupy space until they collapse or implode.

The bleed slots 40,42 of the subject invention serve to provide a low cost and effective way to control the entrained air in the oil. By controllably pre-pressurizing the air entrained oil just prior to it exiting from the tooth space into the outlet passage, the air bubbles/pockets are compressed and reduced in size thus substantially reducing the noise level caused by the bubbles/pockets suddenly collapsing or imploding. By utilizing the bleed slots of the subject invention, the volume of oil/air in the tooth cavity is controllably pressurized to reduce the size of the air bubbles/pockets prior to the oil entering the outlet passage 36.

Thus the method for producing a gear pump having structure that reduces noise levels therein caused by air in the oil includes the steps of forming a housing having a first surface, first and second intersecting cavities generally perpendicular to the first surface, first and second shaft bores at the bottom of the respective first and second intersecting cavities, a second surface at the bottom of the first and second intersecting cavities, an inlet passage communicating with at least a portion of the first and second surfaces and one side of the intersecting cavities, an outlet passage communicating with at least a portion of the first and second surfaces and the other side of the intersecting cavities; machining the first and second intersecting cavities with a boring tool; machining a first bleed slot with the boring tool at a location generally adjacent the intersection of the first cavity, the first surface, and the outlet passage; machining a second bleed slot with the boring tool at a location generally adjacent the intersection of the second cavity, the first surface, and the outlet passage, the first and second bleed slots each being arcuate in shape and of a length generally equal to the space between two adjacent tooth points and a cross-sectional area at its mid-point along the arcuate length determined by multiplying the flow of the pump at a given speed times a derived constant of 0.12; inserting intermeshing first and second gears having gear shafts extending therefrom in the respective first and second intersecting cavities and the respective shaft bores; placing a cover plate having a third surface and first and second shaft bores therein over the respective gear shafts of the respective intermeshing first and second gears; and securing the housing and cover plate with fasteners.

In an alternate embodiment, the housing 12 or body 22 is formed by a powder metallurgy process, a die casting process, or any other process that produces a substantially finished product. In this alternate embodiment process, the first and second intersecting cavities 30,32 and the first and second bleed slots 40,42 are finished formed. In some instances, it is necessary to finish machine the first and second intersecting cavities 30,32 in order to maintain the needed tolerances to reduce leakage therein.

In view of the foregoing, it is readily apparent that the subject method and apparatus provides a gear pump that can operate with air entrained oil without generating large volumes of noise. This is accomplished by providing bleed slots 40,42 therein in a very low cost and efficient manner.

Other aspects, objects and advantages of the invention can be obtained from a study of the drawings, the disclosure and the appended claims.

We claim:

1. A gear pump having a bleed slot configuration to reduce the noise and pressures attributed to air in the oil, the gear pump comprising:

a housing with a first surface, first and second intermeshing gears disposed in respective first and second intersecting cavities, each of the first and second intersecting cavities define a radius;

a cover plate secured to the housing in contact with the first surface;

an inlet passage communicating with one side of the intermeshing gears and an outlet passage communicating with the opposite side of the intermeshing gears;

a first bleed slot defined in the housing generally adjacent the intersection of the surface, the first cavity, and the outlet passage; and a second bleed slot defined in the housing generally adjacent the intersection of the surface, the second cavity, and the outlet passage, the first and second bleed slots each having an arcuate length generally equal to the length between corresponding points on adjacent teeth of the associated gears.

2. The gear pump of claim 1 wherein the respective bleed slots have the largest cross-sectional area at a location adjacent the outlet passage and decreases in cross-sectional area along its arcuate length to the intersection with the respective first and second cavities.

3. The gear pump of claim 2 wherein the cross-sectional area of the respective bleed slots at the mid-point of their arcuate length is determined by multiplying the volumetric flow of the pump at a given input speed times a derived constant that is based generally on the percent of air in the oil.

4. The gear pump of claim 3 wherein each of the bleed slots defines a radius that is substantially equal to the radius of the respective first and second intersecting cavities.

5. The gear pump of claim 4 wherein the given input speed is approximately 1800 rpm and the derived constant is in the range of 0.08 to 0.16.

6. The gear pump of claim 5 wherein the derived constant is approximately 0.12.

7. The gear pump of claim 1 wherein the housing is made from powder metallurgy.

8. The gear pump of claim 1 wherein the housing is a die casting.

* * * * *